United States Patent [19]

Kamino et al.

[11] 4,324,597

[45] Apr. 13, 1982

[54] MAGNETIC ALLOY

[75] Inventors: Kimiyaki Kamino, Tokyo; Masakatsu Fukuda, Sendai, both of Japan

[73] Assignee: Mitsubishi Seiko Kabushiki Kaisha, Japan

[21] Appl. No.: 113,723

[22] Filed: Jan. 21, 1980

Related U.S. Application Data

[63] Continuation of Ser. No. 965,285, Dec. 1, 1978, abandoned.

[30] Foreign Application Priority Data

Dec. 27, 1977 [JP] Japan ..... 54/156429

[51] Int. Cl.[3] ..... H01F 1/02

[52] U.S. Cl. ..... 148/103; 148/102; 148/31.57; 75/126 H

[58] Field of Search ..... 75/122, 134 F, 126 H, 75/126 E, 126 C, 126 F; 148/31.57, 102, 103, 108, 121

[56] References Cited

U.S. PATENT DOCUMENTS

| | | | |
|---|---|---|---|
| 3,806,336 | 4/1974 | Kaneko et al. | 75/122 |
| 3,954,519 | 5/1976 | Inoue | 148/31.57 |
| 4,008,105 | 2/1977 | Yuda et al. | 148/31.57 |
| 4,075,437 | 2/1978 | Chin et al. | 148/31.57 |
| 4,093,477 | 6/1978 | Iwata et al. | 148/31.57 |
| 4,120,704 | 10/1978 | Anderson | 148/31.57 |
| 4,174,983 | 11/1979 | Chin et al. | 148/102 |

FOREIGN PATENT DOCUMENTS

| | | | |
|---|---|---|---|
| 49-20451 | 5/1974 | Japan . | |
| 50-142416 | 11/1975 | Japan . | |
| 51-5612 | 2/1976 | Japan | 75/126 H |
| 52-98613 | of 1977 | Japan . | |
| 52-139614 | 11/1977 | Japan . | |

*Primary Examiner*—L. Dewayne Rutledge
*Assistant Examiner*—John P. Sheehan
*Attorney, Agent, or Firm*—Amster, Rothstein & Engelberg

[57] ABSTRACT

A magnetic alloy of the Fe-Cr-Co type having superior magnetic properties compared to those of the conventional magnetic alloys of this kind and consisting essentially of, by weight, 5 to 30% Co, 0.15 to 35% Cr, 0.1 to 10% Ti, 0.1 to 10% V, 0.1 to 5% of one element selected from the group consisting of W, Mo, Zr and Ta, and the balance being Fe.

3 Claims, 1 Drawing Figure

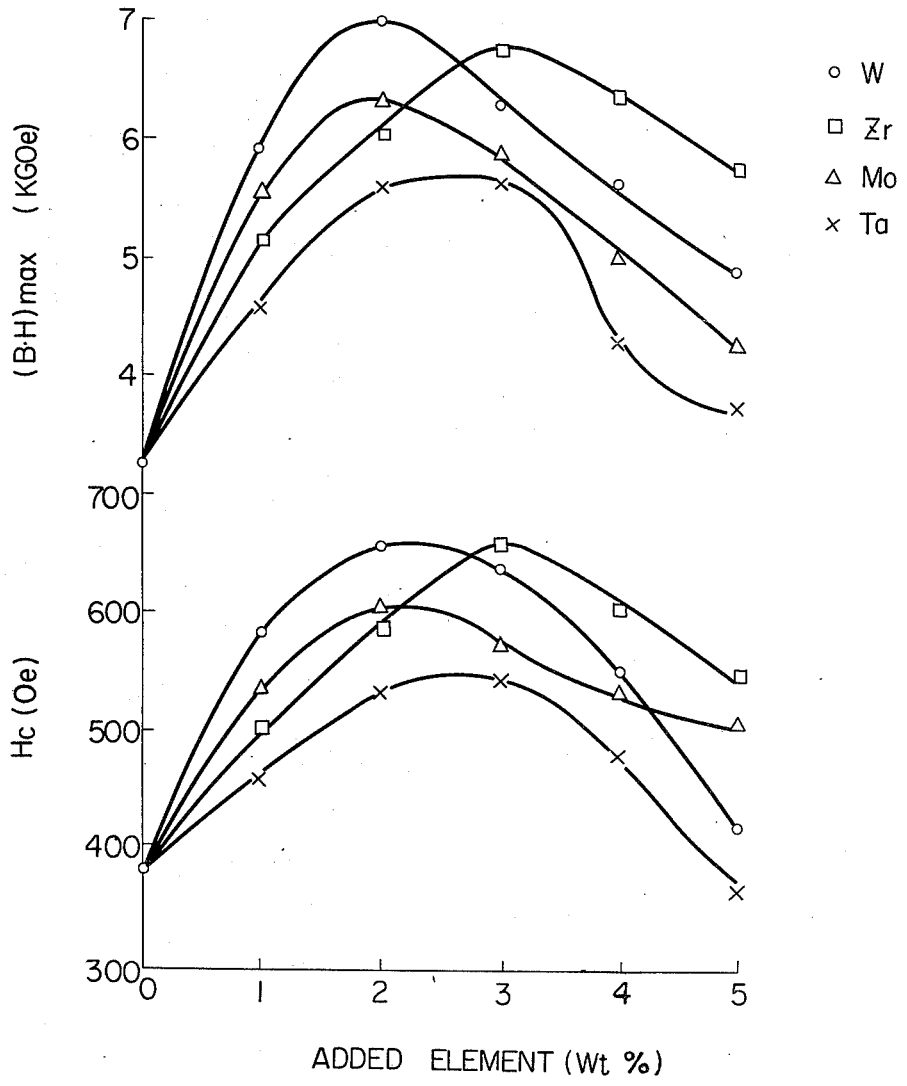
7
6
5
4
(B·H)max (KGOe)
700
600
500
400
300
Hc (Oe)
0
1
2
3
4
5
ADDED ELEMENT (Wt %)
W
Zr
Mo
Ta

MAGNETIC ALLOY

This is a continuation of application Ser. No. 965,285, filed Dec. 1, 1978, abandoned.

BACKGROUND OF THE INVENTION

The present invention relates to a magnetic alloy and more particularly to a magnetic alloy of the Fe-Cr-Co type such as is usually known in the art as a magnetic alloy of the spinodal decomposition type.

As spinodal decomposition magnetic alloys of this kind, for instance, hitherto a Fe-Cr-Co alloy as disclosed in Japanese Patent Publication No. 20451/1974 has been known. However, in this three-element alloy, in order to obtain at room temperature an $\alpha$-phase which usually appears at a higher temperature, the alloy must be cooled rapidly from a temperature above 1,300° C. As a measure to eliminate the $\gamma$- and/or $\sigma$-phases which appear when the alloy is not subjected to a rapid cooling and which adversely affect the alloy magnetically as well as mechanically, one which extends the $\alpha$-phase to a lower temperature range by the addition of Nb and Al has been known. (see Japanese Laid-Open Patent Publication No. 142416/1975.) Further, a magnetic alloy in which V is added in an amount of 0.1 to 15 wt% for the purpose of expanding the $\alpha$-phase as well as lowering the solution heat treatment temperature has been also known. (See Japanese Laid-Open Patent Publication No. 98613/1977.)

SUMMARY OF THE INVENTION

It is an object of the present invention to provide a magnetic alloy of the Fe-Cr-Co type in which magnetic properties can be improved to better than those of conventional magnetic alloys of this kind.

It is another object of the present invention to provide a magnetic alloy of the Fe-Cr-Co-V-Ti type which has superior magnetic properties compared to conventional casting type magnets and yet is easily machinable.

In order to achieve this object, according to the present invention a magnetic alloy of the Fe-Cr-Co type is provided which consists essentially of, by weight, 5 to 30%Co, 15 to 35%Cr, 0.1 to 10%Ti, 0.1 to 5% of one element selected from the group consisting of W, Mo, Zr and Ta, and the balance being Fe.

BRIEF DESCRIPTION OF THE DRAWING

These and other objects of the present invention will become more readily apparent upon reading of the following specification and upon reference to the accompanying drawing which is a diagram showing the variation in magnetic properties in the case where a part of the Fe contained in a five-element magnetic alloy comprising 18%Co-22%Cr-1%V-1%Ti-Fe is respectively replaced by W, Mo, Zr or Ta in successive amounts of 1, 2, 3, 4 and 5 wt%, whereby the abscissa represents the amount of added elements in wt% and the ordinate represents the coercive force Hc in Oe and the magnetic energy product (B·H) max in KGOe.

DESCRIPTION OF THE PREFERRED EMBODIMENTS

First of all the reasons why in the present invention the respective elements and their content ranges have been selected as above described will be explained.

As to Co, when its content is below 5 wt% the spinodal decomposition occurs difficultly and the decrease in coercive force Hc is remarkable. Its upper limit of 30 wt% has been determined due to the fact that if the content of Co exceeds this upper limit the solution heat treatment becomes difficult and the plastic workability is also lowered even if the Cr-content is decreased.

As to Cr, when it is added below 15 wt%, even if the content of Co is increased, the ratio of the non magnetic phase obtainable by the spinodal decomposition is considerably decreased so that sufficient coercive force as a permanent magnet is not able to be generated. On the other hand, if Cr is added above 35 wt% the ratio of the non magnetic phase is increased and the magnetic energy product is remarkably decreased, the hardness being increased and the workability deteriorating. Thus the content range of Cr has been decided to be 15 to 35 wt%.

Next the elements to be added for the purpose of improving the magnetic properties of the abovementioned fundamental magnetic alloy of the Fe-Cr-Co type in accordance with the present invention will be explained.

As to V, as apparent from the description of the Japanese Laid-Open Patent Publication No. 98613/1977, it is effective to widen the region of the $\alpha$-phase as well as to remarkably retard the time period during which the $\alpha$-phase appears, since the $\sigma$-phase is not desirable in terms of machinability and magnetic properties. Therefore, the content range of V has been determined to be 0.1 to 10 wt%.

It has been known that in order to lower the solution heat treatment temperature it is effective to add Al, Si, Ti, Nb and etc., to a four-element magnetic alloy of the Fe-Cr-Co-V type, in an amount of 0.1 to 3 wt% in place of a part of the Fe contained in the alloy. (See Japanese Laid-Open Patent Publication No. 139614/1977.) Although the magnetic alloy according to the present invention can be deemed as being fundamentally a kind of five-element magnetic alloy of the Fe-Cr-Co-V-Ti type with Ti being added in an amount of 0.1 to 10 wt% to the above four-element magnetic alloy of the Fe-Cr-Co-V type, in the present invention a single element selected from the group consisting of W, Mo, Zr and Ta is further added in an amount of 0.1 to 5 wt% as the sixth element. With this addition of any one of these elements the magnetic properties of the magnetic alloys according to the present invention are further improved as apparent from examples to be described below.

EXAMPLE 1

Pure iron for industrial use, electrolytic cobalt, low-carbon ferro-chromium, ferro-vanadium, low carbon ferrotitanium and ferro-tungsten were weighed, separately, as shown in Table 1. After the thus weighed raw materials were melted in an air atmosphere with a high-frequency induction furnace they were powered into shell-molds and samples each having dimentions of 13 mm in diameter $\times$12 mm in length were manufactured. After the thus manufactured samples were subjected to a solution heat treatment they were held in a magnetic field (about 3 KOe) between a temperature of 650° to 700° C. for 30 minutes, then being subjecting to conventional multi-stage aging at steps of 20° C. until they reached a temperature of 500° C., the magnetic properties of the respective samples, measured after the heat treatment, are shown in Table 2. As apparent from Tables 1 and 2, the coercive force Hc is increased by replacing a part of the V contained in the alloy with W, and excellent magnetic alloys are obtained in which the magnetic energy product (B·H) max exceeds 7 MGOe. As apparent from sample Nos. 5 and 6, the coercive force Hc decreases at the vicinity of the limiting values of the ranges of the respective elements in the magnetic alloy according to the present invention, and also the magnetic energy product (B·H) max considerably decreases. Further, if the composition of the alloy deviates from that of the present invention the value of (B·H) max becomes lower than 1 MGOe, the alloy losing its significance as a magnetic alloy. At this point it should be noted that in the composition of the magnetic alloy according to the present invention such impurities as usually contained in ferro alloys or as introduced in the course of the mannufacture do not affect the magnetic properties.

TABLE 1

| Sample No. | Co | Cr | Ti | V | W | Fe |
|---|---|---|---|---|---|---|
| 1 | 15 | 21 | 2 | 3 | 0 | Balance |
| 2 | 15 | 21 | 2 | 2 | 1 | Balance |
| 3 | 15 | 21 | 2 | 1 | 2 | Balance |
| 4 | 15 | 21 | 2 | 0 | 3 | Balance |
| 5 | 10 | 30 | 3.5 | 1.5 | 2.5 | Balance |
| 6 | 25 | 20 | 1 | 3 | 2 | Balance |

TABLE 2

| Sample No. | Br(XG) | Hc(Oe) | (B . H)max(MGOe) |
|---|---|---|---|
| 1 | 14.3 | 570 | 6.3 |
| 2 | 14.7 | 650 | 7.2 |
| 3 | 14.8 | 630 | 6.8 |
| 4 | 15.0 | 600 | 6.1 |
| 5 | 10.5 | 250 | 1.9 |
| 6 | 13.0 | 450 | 3.8 |

EXAMPLE 2

Into a magnetic alloy comprising 18%Co-22%Cr-1%V-1%Ti-Fe, W, Mo, Zr and Ta were respectively added so as to successively replace 1, 2, 3, 4 and 5 wt% of the Fe contained in the alloy and samples were prepared by the same procedure as in Example 1. The test results are shown in the affixed drawing. As apparent from it, although W and Mo reveal that they can remarkably improve the coercive force Hc by being added in relatively small amounts, Zr and Ta show that they must be added in larger mounts in order to exhibit a similar effect. Furhter, the limit of the addition of the respective elements is 5 wt%, because the addition of more than this amount causes the magnetic properties to decrease below the samples in which no W, Mo, Zr or Ta are added.

What is claimed is:

1. In a five element spinodal decomposition-type magnetic alloy consisting essentially of, by weight, 5 to 30% Co, 15 to 35% Cr, 0.1 to 10% Ti, 0.1 to 10% V, and the balance being Fe, wherein the improvement comprises increasing the magnetic energy product of said alloy by the replacement of a portion of said Fe by about 0.1 to 5% of one element selected from the group consisting of W, Mo and Zr in an amount sufficient to increase said magnetic energy product of said alloy to greater than about 4 MGOe.

2. The magnetic alloy as set forth in claim 1 wherein said W, Mo and Zr are added in an amount of about, by weight, 1 to 3%, 1 to 4, and 2 to 4, respectively, wherein said magnetic energy product is greater than about 5 MGOe.

3. A process for producing a spinodal decomposition-type magnetic alloy consisting essentially of, by weight, 5 to 30% Co, 15 to 35% Cr, 0.1 to 10% Ti, 0.1 to 10% V, 0.1 to 5% of one element selected from the group consisting of W, Mo, and Zr, and the balance being Fe, comprising the steps of: forming an ingot of said alloy; subjecting said ingot to a solution heat treatment; subsequently holding said ingot in a magnetic field of about 3 MGOe at a temperature in the range of about 650° to 700° C. for about 30 minutes, and finally subjecting said ingot to multistage aging steps of 20° C. until a termperature of about 500° C. is reached.

* * * * *